US011103032B2

(12) United States Patent
Huang

(10) Patent No.: US 11,103,032 B2
(45) Date of Patent: Aug. 31, 2021

(54) HALF-ROUND ZIPPER AND SLIDER THEREFOR

(71) Applicant: Bright Technology Co., Ltd, Dongguan (CN)

(72) Inventor: Guoliang Huang, Dongguan (CN)

(73) Assignee: BRIGHT TECHNOLOGY CO., LTD, Dongguan (CN)

( * ) Notice: Subject to any disclaimer, the term of this patent is extended or adjusted under 35 U.S.C. 154(b) by 161 days.

(21) Appl. No.: 16/470,975

(22) PCT Filed: Nov. 20, 2018

(86) PCT No.: PCT/CN2018/116328

§ 371 (c)(1),
(2) Date: Jun. 19, 2019

(87) PCT Pub. No.: WO2019/105257

PCT Pub. Date: Jun. 6, 2019

(65) Prior Publication Data

US 2021/0085038 A1 Mar. 25, 2021

(30) Foreign Application Priority Data

Nov. 29, 2017 (CN) ..... 201721637248.4
Nov. 29, 2017 (CN) ..... 201721637413.6

(51) Int. Cl.
*A44B 19/26* (2006.01)
*A44B 19/04* (2006.01)

(52) U.S. Cl.
CPC ..... *A44B 19/26* (2013.01); *A44B 19/04* (2013.01)

(58) Field of Classification Search
CPC ..... A44B 19/26; A44B 19/04
See application file for complete search history.

(56) References Cited

U.S. PATENT DOCUMENTS 2,032,858 A * 3/1936 Schaper ..... A44B 19/26 24/414
2,095,270 A * 10/1937 Silberman ..... A44B 19/26 24/426

(Continued)

FOREIGN PATENT DOCUMENTS

CN 2742610 Y 11/2005
CN 203828207 U 9/2014

(Continued)

OTHER PUBLICATIONS

International Search Report for PCT/CN2018/116328.

(Continued)

*Primary Examiner* — Robert Sandy
*Assistant Examiner* — Louis A Mercado

(57) ABSTRACT

A half-round zipper is provided, including chain teeth, top stops and teeth stringers. Each of the chain teeth has a tooth root provided with a left tooth and a right tooth curved with respect to each other, and has a tooth top provided with an engaging boss and an engaging groove which are arranged respectively on both sides of the tooth top and configured to be engagable with each other, and has an arc-shaped longitudinal cross-section with the center angle of a right angle. Two of the chain teeth are engaged with each other to form a half-round shape. Each of the top stops includes an upper end portion with an arc cross-section and a lower end portion with a horizontally or obliquely flat bottom surface, and is engaged to the inner side of the respective one of the teeth stringers by means of a first holding groove.

7 Claims, 10 Drawing Sheets

(56) References Cited

U.S. PATENT DOCUMENTS

| | | | | | |
|---|---|---|---|---|---|
| 2,097,099 | A | * | 10/1937 | Legat | A44B 19/04 24/411 |
| 2,160,819 | A | * | 6/1939 | Behrens | A44B 19/26 24/428 |
| 2,160,879 | A | * | 6/1939 | Lawson | A44B 19/26 24/427 |
| 2,316,787 | A | * | 4/1943 | Gould | A44B 19/04 24/432 |
| 2,563,767 | A | * | 8/1951 | Winterhalter | A44B 19/04 24/411 |
| 3,238,285 | A | * | 3/1966 | Morin | A44B 19/04 264/252 |
| D845,831 | S | * | 4/2019 | Hung | D11/221 |
| D906,878 | S | * | 1/2021 | Lu | D11/221 |
| 2012/0036685 | A1 | | 2/2012 | Wang | |

FOREIGN PATENT DOCUMENTS

| | | | |
|---|---|---|---|
| CN | 206641465 | U | 11/2017 |
| CN | 207574636 | U | 7/2018 |
| CN | 207574637 | U | 7/2018 |

OTHER PUBLICATIONS

International Publication for PCT/CN2018/116328.
Written Opinion of the International Search Authority for PCT/CN2018/116328.

* cited by examiner

HALF-ROUND ZIPPER AND SLIDER THEREFOR

TECHNICAL FIELD

The present application relates to a field of zipper, and in particular to a half-round zipper and a slider therefor.

BACKGROUND

Zipper is a connector that utilizes two continuous rows of chain teeth to bind or separate items, which is widely used in clothing, bags, tents, etc. The zipper generally includes fasteners from two teeth stringers each having a row of metal or plastic teeth for connecting edges of an opening (e.g., of a garment or a pocket). And a sliding part (i.e., slider) is provided for forcing the two rows of teeth into an interlocking position to close the opening.

The zipper in the prior art mainly has a flat shape and a rectangular cross-section. The surface shape of this kind of zipper is usually molded to be flat with a single structure and a simple shape, which cannot meet the special requirements of some consumers. The smoothness of the zipper during use is a great reference standard for the user to consider the zipper, which not only affects the comfort of the user during use, but also affects the service life of the zipper. The zipper in the prior art is typically not smooth enough, which accelerates the wear of the zipper teeth, and leads to insufficient engaging force of the zipper teeth, incomplete closure of the zipper, and even detachment of the teeth, thus reducing the overall service life of the zipper.

The zipper in the prior generally has a locking member with a flat structure which is used in cooperation with the zipper teeth. The locking member has a socket provided with an engaging groove and a slot, and the engaging groove is engaged with one of the teeth stringers. In the prior art, the clamping force of the opening of the engaging groove to the respective teeth stringer is relatively small, and an external force needs to be applied on both sides of the socket to tightly combine the engaging groove and the respective teeth stringer. However, the opening of the engaging groove is easily staggered when the external force is applied due to the rectangular cross-section of the engaging groove. Generally, the locking member in the art is provided with a latch integrally formed, and the upper and lower dimensions of the latch are substantially consistent. In this regard, the latch easily gets stuck when being pulled out from the socket, such that abrasion between parts of the locking member is increased to result in discomfort of the user. Moreover, too much material is expended for the chain teeth of the zipper in the prior art, leading to low production efficiency and high production cost.

SUMMARY

A half-round zipper with improved top stops and chain teeth is provided for solving the above-mentioned problems, such that engagement between the top stops and the teeth stringers is enhanced, abrasion of the zipper is reduced, production cost is lowered and comfort of the user is improved.

The present application is realized by the following technical solutions.

A half-round zipper is provided according to the present application, including chain teeth, at least two top stops and at least two teeth stringers, wherein each of the chain teeth has a tooth root provided with a la tooth and a right tooth curved with respect to each other, each of the chain teeth has a tooth top provided with an engaging boss and an engaging groove which are arranged respectively on both sides of the tooth top and configured to be engagable with each other, each of the chain teeth has an arc-shaped longitudinal cross-section with the center angle of a right angle, two of the chain teeth are engaged with each other to form a half-round shape, the left tooth, the right tooth and the tooth root form an arcuate groove configured to be fixedly engaged with the teeth stringer, the center of the engaging boss is located above the left tooth, and the engaging boss is provided with an upper end face that has a smaller size compared with an lower end face thereof; and wherein each of the at least two top stops includes an upper end portion with an arc cross-section and a lower end portion with a horizontally or obliquely flat bottom surface, a first holding groove is provided at the outer side of each of the at least two top stops and is engaged to the inner side of a respective one of the at least two teeth stringers, and each of the at least two top stops 4 is located at the top end of the respective one of the at least two teeth stringers by means of the first holding groove.

In one embodiment, the half-round zipper further includes a bottom stop that has a height greater than that of one of the chain teeth, wherein two teeth strings are provided, and two top stops are provided each of which is engaged to the top end of a respective one of the two teeth stringers, the bottom stop is engaged to the lower ends of the two teeth stringers to connect the teeth stringers with each other, the bottom stop includes an upper holding portion, an intermediate transition portion, and a lower holding portion, two holding grooves symmetrical to each other with respect to the central axis of the bottom stop are formed between the upper engaging portion and the lower engaging portion, the two holding grooves include a second holding groove and a third holding groove, each of which is engaged to the inner side of a respective one of the two teeth stringers.

In one embodiment, the upper holding portion has an arc-shaped top surface, the lower holding portion 23 has a flat or concave bottom surface, and the second holding groove and the third holding groove are equal in shape and size.

In one embodiment, each of the second holding groove and the third holding groove has a width increased and then decreased inward from the opening, and has a first inner wall located at the intermediate transition portion and being arc-shaped, and has a second inner wall located at the upper holding portion and provided with a snap notch, and has a third inner wall located at the lower holding portion and being horizontally or obliquely flat.

In one embodiment, the half-round zipper further includes a socket and a latch, wherein two teeth strings are provided, and the socket includes a base and a first protruding part located above the base, a fourth holding groove is provided on the outer side of the socket, and a slot is provided inside the base, the base one other side surface along the longitudinal direction being curved or a vertically flat, the latch includes a snap part and a second protruding part located at one side of the latch above the snap part, a fifth holding groove is provided on the outer side of the latch, the snap part has a width smaller than that of the second protruding part, the snap part is inserted into the slot, and each of the fourth holding groove and the fifth holding groove is engaged to a respective one of the two teeth stringers, the base has one side surface along the longitudinal direction being curved, each of the first protruding part and the second protruding part is shaped as notched right-angle arc in cross-section, each of the fourth holding groove and the fifth holding groove has its width gradually decreases inward from the opening.

In one embodiment, an inclined part is provided on the contact surface between the slot and the base, having an inclined angle of 45 degrees to 75 degrees.

In one embodiment, a step is provided at an upper end of the second protruding part, and a step surface of the step is provided inside the second protruding part, and the second protruding part has a height greater than or equal to the sum of the heights of one of the chain teeth and the first protruding part.

A slider for use with a zipper according to the present application is provided, including a head and a trunk, the head is provided with an upper plate and a lower plate, the head further includes two guiding ports and an engaging port, the lower plate is flat, the upper plate is half-round shaped in longitudinal cross-section at one end of the engaging port, and the trunk has a fixed curved structure.

A slider for use with a zipper according to the present application is provided, including a head and a trunk, the head is provided with an upper plate and a lower plate, the head further includes two guiding ports and an engaging port, the lower plate is flat, the upper plate is half-round shaped in longitudinal cross-section at one end of the engaging port.

In one embodiment, the trunk includes an upper nose and a lower nose, the upper plate is provided with an opening arranged on one side of the lower nose, a middle nose is provided between the upper nose and the lower nose, the upper nose is provided with a hinge hole, the lower nose is provided with a slot, the middle nose is provided with a self-locking member, the middle nose has an upper end hingedly fixed to the upper nose and a lower end movable along the slot, and the self-locking member is inserted into the opening.

The present application has the following advantages:

The half-round zipper according to the present application includes chain teeth each of which has an arc-shaped longitudinal cross-section with the center angle of a right angle, and two of the chain teeth are engaged with each other to form a half-round shape which can meet the user's special requirements for zippers. Due to the half-round shape of the engaged chain teeth with the surface on the outer side of the teeth stringer being smoothly curved and the surface on the inner side of the teeth stringer being flat, the surface on the inner side of the chain teeth is prevented from pressing against the article or the skin during use. As results, damage to the article or the skin by the surface on the inner side of the chain teeth is avoided, the safety and comfort are improved, the expended material can be reduced by half compared to the round shaped zipper, and thus the production cost can be reduced.

DETAILED DESCRIPTION

Figure 1:
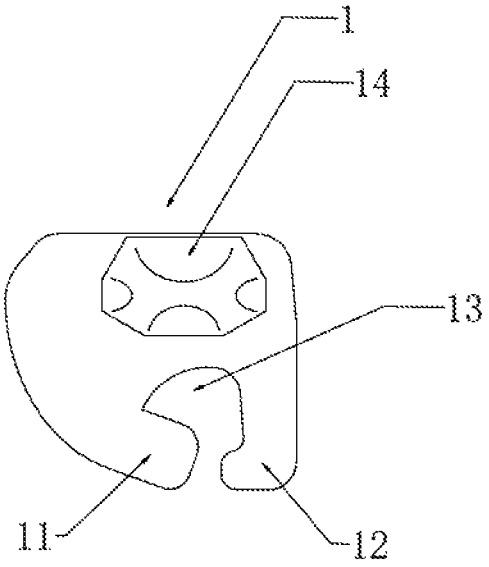
FIG. 1 schematically shows a front view of a chain tooth according to the present application.

The present application will be further described below with reference to the accompanying drawings for more clearly and fully discussing the technical solutions of the present application.

Embodiment 1

As shown in FIGS. 1 to 5, a half-round zipper is provided, including chain teeth 1, at least one top stop 4, at least one bottom stop 2, and teeth stringers. Each chain tooth has a tooth root provided with a left tooth 11 and a right tooth 12. The left tooth 11 and the right tooth 12 are curved with respect to each other. The chain tooth has a tooth top that includes one side provided with an engaging boss 14 and one other side provided with an engaging groove 15. The engaging boss 14 and the engaging groove 15 are configured to be engaged with each other.

Figure 2:
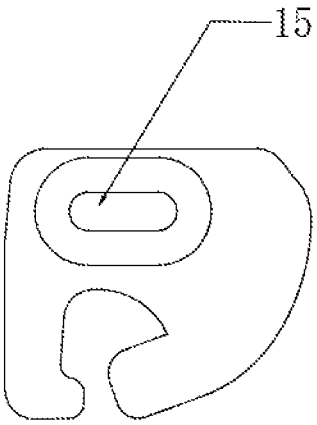
FIG. 2 schematically shows a back view of the chain tooth according to the present application.
Figure 3:
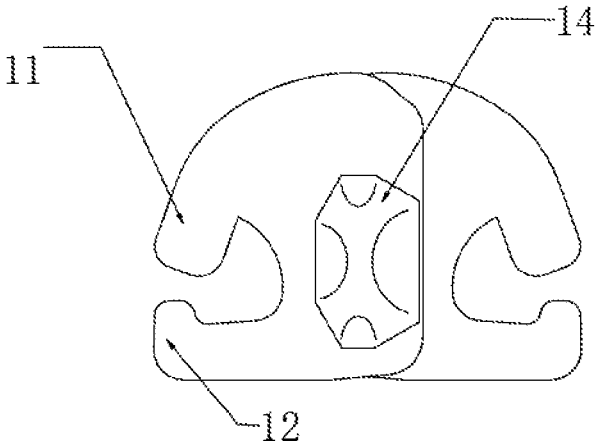
FIG. 3 schematically shows a front view of two chain teeth engaged with each other according to the present application.

As shown in FIGS. 1-3, the chain tooth has an arc-shaped longitudinal cross-section with the center angle of a right angle. Two chain teeth are engaged with each other to form a half-round shape. The left tooth 11, the right tooth 12 and the tooth root form an arcuate groove 13 configured to be fixedly engaged with the teeth stringer. The center of the engaging boss 14 is located above the left tooth 11. The engaging boss 14 is provided with an upper end face that has a smaller size compared with a lower end face thereof, so that the engaging boss 14 can be accurately engaged with the engaging groove 15, and abrasion between the side walls of the engagement boss 14 and the engagement groove 15 is prevented. The engaging boss 14 of one chain tooth is configured to be engaged with the engaging groove 15 of one other chain tooth in such a way that the two chain teeth are engaged with each other to form a half-round shape. In the present embodiment, the engaging boss 14 is of a multi-sided prism structure, preferably an eight-sided prism structure. The top of the engaging boss 14 is chamfered, and preferably has four chamfers. The engaging boss 14 has a protruding height of preferably 0.6 mm to 0.8 mm. The engaging groove 15 is of an inverted prism structure with its size gradually reduced from the opening. The engaging groove 15 has a depth of preferably 0.7 mm to 1.1 mm, which is greater than the height of the engaging boss.

In the present application, the left tooth 11 is a boss portion bent toward the arcuate groove 13 along the arc edge of the chain tooth, and the right tooth 12 is a bending portion bent toward the arcuate groove 13 along the right angle edge of the chain tooth. The left tooth 11 has a relatively larger size compared to the right tooth 12, which can be used for primarily bearing stress during engagement. The left tooth 11 can bear a large stress, such that the right tooth 12 suffers from a relatively small stress and thus is prevented from being damaged. Two chain teeth are engaged with each other to form a half-round shape which can meet the user's special requirements for zippers. Due to the half-round shape of the engaged chain teeth with the surface on the outer side of the teeth stringer being smoothly curved and the surface on the inner side of the teeth stringer being flat, the surface on the inner side of the chain teeth is prevented from pressing against the article or the skin during use. As results, damage to the article or the skin by the surface on the inner side of the chain teeth is avoided, the safety and comfort are improved, the expended material can be reduced by half compared to the round shaped zipper, and thus the production cost can be reduced.

Figure 4:
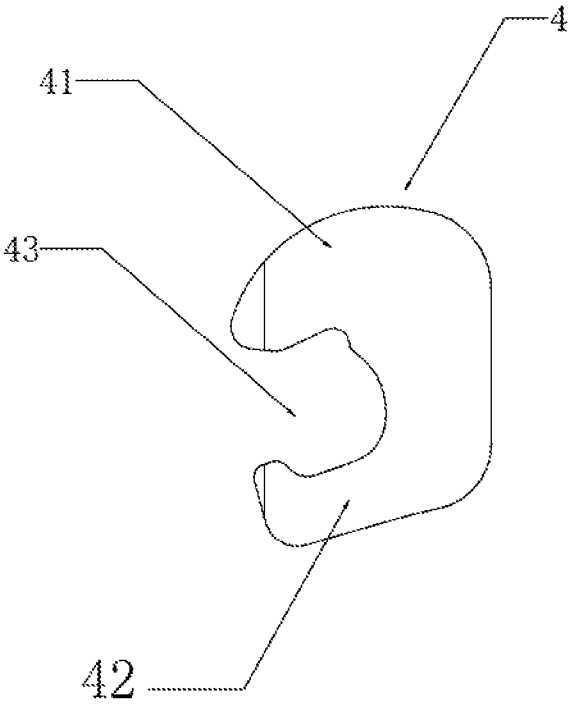
FIG. 4 schematically shows a front view of a top stop according to the present application.

As shown FIG. 4, the top stop 4 includes an upper end portion 41 with an arc cross-section and a lower end portion 42 with a horizontally or obliquely flat bottom surface. The upper end portion 41 and the lower end portion 42 are bent toward the center of the top stop 4 to form a first holding groove 43 that is located at the outer side of the top stop 4 and engaged to the inner side of the teeth stringer.

Figure 5:
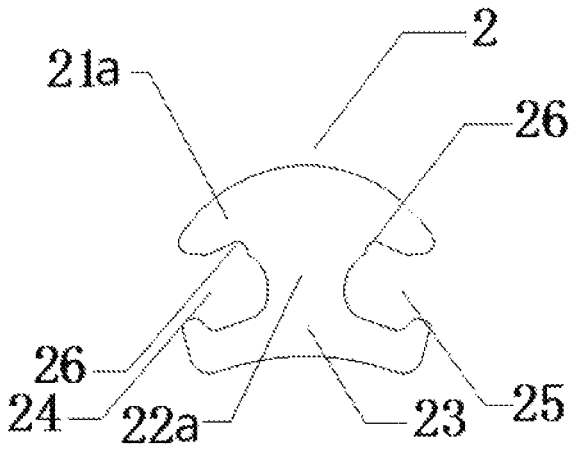
FIG. 5 schematically shows a front view of a bottom stop according to a first embodiment of the present application.

As shown in FIG. 5, the bottom stop 2 includes an upper holding portion 21*a*, an intermediate transition portion 22*a*, and a lower holding portion 23. Two holding grooves symmetrical to each other with respect to the central axis of the bottom stop 2 are formed between the upper engaging portion 21*a* and the lower engaging portion 23. The holding grooves include a second holding groove 24 and a third holding groove 25 respectively engaged to the inner sides of two teeth stringers. The upper holding portion 21*a* has an arc-shaped top surface. The lower holding portion 23 has a flat or concave bottom surface. The second holding groove 24 and the third holding groove 25 are equal in shape and size. The height of the bottom stop 2 is greater than the height of the chain tooth, ensuring that the bottom stop 2 engages firmly at the bottom of the teeth stringers and provides sufficient support for the chain teeth 1 above the bottom stop 2.

Each of the second holding groove 24 and the third holding groove 25 has a width increased and then decreased inward from the opening, and has an first inner wall located at the intermediate transition portion 22*a* and being arc-shaped, and has a second inner wall located at the upper holding portion 21*a* and provided with a snap notch 26, and has a third inner wall located at the lower holding portion 23 and being horizontally or obliquely flat. With each of the second holding groove 24 and the third holding groove 25 having the width increased and then decreased inward from the opening and the innermost side arc-shaped, engaging forces can be more conveniently applied when the second holding groove 24 and the third holding groove 25 are engaged to the teeth stringers, the forces applied by the two holding grooves are more concentrated, the mating tightness between the holding grooves and the teeth stringers is increased, such that the holding grooves would not be deformed easily during use, and looseness between the holding grooves and the teeth stringers is avoided. With each of the second holding groove 24 and the third holding groove 25 having a snap notch 26 provided on the a second inner wall, the snap notch 26 is configured to lock the teeth stringer so as to prevent the bottom stop from falling off during installation. Meanwhile the arc-shaped innermost sides of the holding grooves can ensure that a sufficient margin is provided for engaging to the teeth stringers as much as possible, and thus ensure a secure installation of the bottom stop 2. With The lower holding portion 23 of the bottom stop 2 having the flat or concave bottom surface, easy clamping of the bottom stop during the engaging process is ensured, and as well as a more stable engagement.

The first holding groove 43 has an arc-shaped wall at its innermost side, and has a side wall located near the upper end portion 41 and provided with a snap notch 26, and has a side wall located near the lower end portion 42 and being horizontally or obliquely flat. The first holding groove 43 may function as the second holding groove 24 and the third holding groove 25.

In the present application, a zipper with a single round head closed and a zipper with both round heads closed are provided.

The zipper with a single round head closed includes chain teeth 1, two top stops 4, a bottom stop 2 and two teeth stringers. Each of the two top stops 4 is engaged to the inner side located at the upper of the respective one of the two teeth stringers. The bottom stop 2 is engaged to the lower of the teeth stringers with each of the second holding groove 24 and the third holding groove 25 engaged to the inner side of the respective one of the two teeth stringers.

The zipper with both round heads closed includes chain teeth 1, a top stop 4, a bottom stop 2 and two teeth stringers. In one embodiment, each of the two teeth stringers has one end engaged to the bottom stop 2 and one other end engaged to the top stop 4, so that the zipper might has its both ends simultaneously closed. Two sliders are provided on the teeth stringers, and the zipper is in an "O" shape when the two sliders open the chain teeth. In a further embodiment, the zipper is in a "X" shape when the two sliders are located close to the middle of the teeth stringers.

The top stop 4 and the bottom stop 2 provided by the present application are used in cooperation with the above-mentioned half-round chain teeth 1. According to the above-mentioned structure of the top stop 4 and the bottom stop 2, the bottom stop 2 includes a upper holding portion 21*a* with an arc-shaped top surface and a lower holding portion 23 with a flat or concave bottom surface, the top stop 4 includes an upper end portion 41 with an arc cross-section and a lower end portion 42 with a horizontally or obliquely flat bottom surface. Both of the top stop 4 and the bottom stop 2 are flat at the bottom placed on the inner side of the teeth stringers during use, so as to prevent the user from injury and provide improved safety and comfort for the user.

Figure 6:
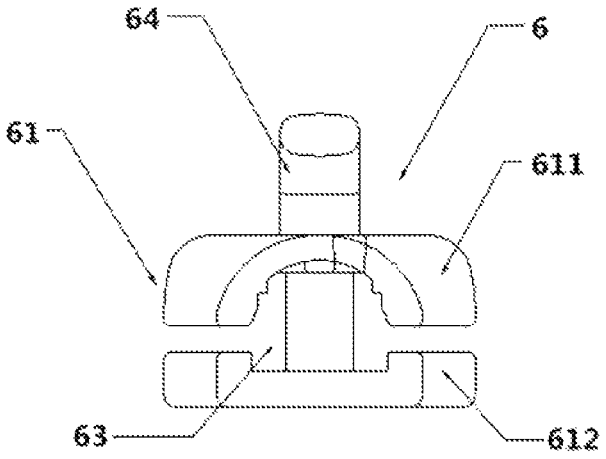
FIG. 6 schematically shows a bottom view of a slider according to the first embodiment of the present application.
Figure 7:
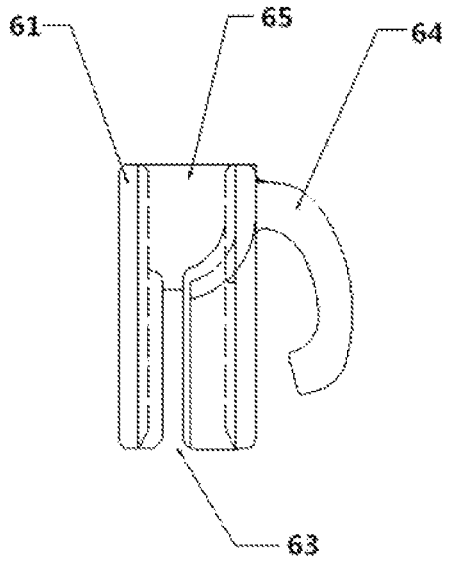
FIG. 7 schematically shows a left view of the slider according to the first embodiment of the present application.
Figure 8:
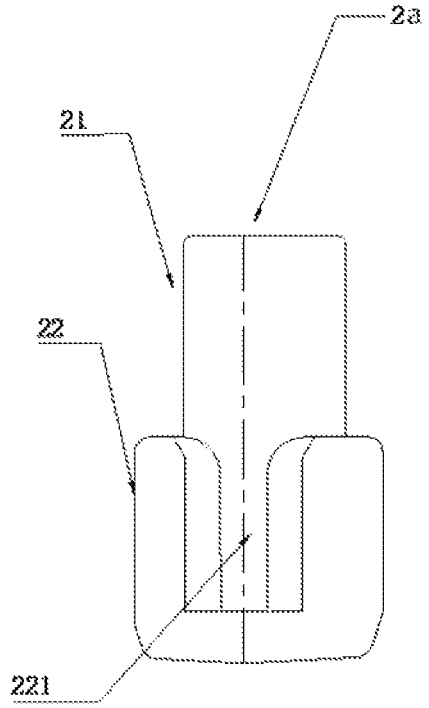
FIG. 8 schematically shows a left view of a socket according to a second embodiment of the present application.
Figure 9:
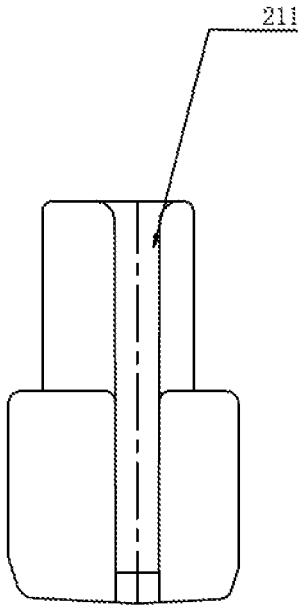
FIG. 9 schematically shows a right view of the socket according to the second embodiment of the present application.

As shown in FIGS. 6-7, a slider 6 for use with the above zipper is also provided according to the present application, including a head 61 and a trunk 64. The head 61 is provided with an upper plate 611 and a lower plate 612 which are connected to each other by a support core. The head 61 further includes a guiding port 65 and an engaging port 63. The guiding port 65 is divided into two equal parts by the support core to facilitate that the teeth stringers of the zipper is inserted from the two parts of the guiding port 65 into the slider, and then slides out of the engaging port 63. The engaging boss 14 and the engaging groove 15 are engaged with each other to ensure sufficient engaging force between the chain teeth. The lower plate 612 is flat, and the upper plate 611 is half-round shaped in longitudinal cross-section at one end of the engaging port 63. The chain teeth 1 according to the present application are half-round with the upper surface thereof smoothly curved, and the chain teeth 1 are used in cooperation with the slider 6 so as to ensure sufficient lubrication between the chain teeth 1 and the slider 6 when the chain teeth 1 pass through the engaging port. Friction between the slider 6 and the upper surface of the chain teeth 1 can be reduced, and the service life of the zipper can be improved. The trunk 64 according to the present application has a fixed curved structure.

Embodiment 2

As shown in FIGS. 1-4 and 8-17, a half-round zipper is provided, including chain teeth 1, a socket 2*a*, a latch 3, at least one top stop 4, and teeth stringers. Each chain tooth has a tooth root provided with a left tooth 11 and a right tooth 12. The left tooth 11 and the right tooth 12 are relatively curved. The chain tooth has a tooth top that includes one side provided with an engaging boss 14 and one other side provided with an engaging groove 15. The engaging boss 14 and the engaging groove 15 are configured to be engaged with each other. A first engaging groove 43 is provided on the outer side of the top stop 4. Each top stop 4 is located at the top end of a respective one of the teeth stringers, and each of the socket 2*a* and the latch 3 are provided at the bottom end of a respective one of the teeth stringers.

As shown in FIGS. 1-3, the chain tooth has an arc-shaped longitudinal cross-section with the center angle of a right angle. Two chain teeth are engaged with each other to form a half-round shape. The left tooth 11, the right tooth 12 and the tooth root form an arcuate groove 13 configured to be fixedly engaged with the teeth stringer. The center of the engaging boss 14 is located above the left tooth 11. The engaging boss 14 is provided with an upper end face that is smaller than an lower end face thereof, so that the engaging boss 14 can be accurately engaged with the engaging groove 15, and abrasion between the side walls of the engagement boss 14 and the engagement groove 15 is prevented. The engaging boss 14 of one chain tooth is configured to be engaged with the engaging groove 15 of one other chain tooth in such a way that the two chain teeth are engaged with each other to form a half-round shape. In one embodiment, the engaging boss 14 is of a multi-sided prism structure, preferably an eight-sided prism structure. The top of the engaging boss 14 is chamfered, and preferably has four chamfers. The engaging boss 14 has a protruding height of preferably 0.6 mm to 0.8 mm. The engaging groove 15 is of an inverted prism structure with its size gradually reduced from the opening. The engaging groove 15 has a depth of preferably 0.7 mm to 1.1 mm. The depth of the engaging groove 15 is greater than the height of the engaging boss.

In the present application, the left tooth 11 is a boss portion bent toward the arcuate groove 13 along the arc edge of the chain tooth, and the right tooth 12 is a bending portion bent toward the arcuate groove 13 along the right angle edge of the chain tooth. The left tooth 11 has a relatively larger size compared to the right tooth 12, which can be used for primarily bearing stress during engagement. The left tooth 11 can bear a large stress, such that the right tooth 12 suffers from a relatively small stress and thus is prevented from being damaged. Two chain teeth are engaged with each other to form a half-round shape which can meet the user's special requirements for zippers. Due to the half-round shape of the engaged chain teeth with the surface on the outer side of the teeth stringer being smoothly curved and the surface on the inner side of the teeth stringer being flat, the surface on the inner side of the chain tooth is prevented from pressing against the article or the skin during use. As results, damage to the article or the skin by the surface on the inner side of the chain teeth is avoided, the safety and comfort are improved, the expended material can be reduced by half compared to the round shaped zipper, and thus the production cost can be reduced.

Figure 12:
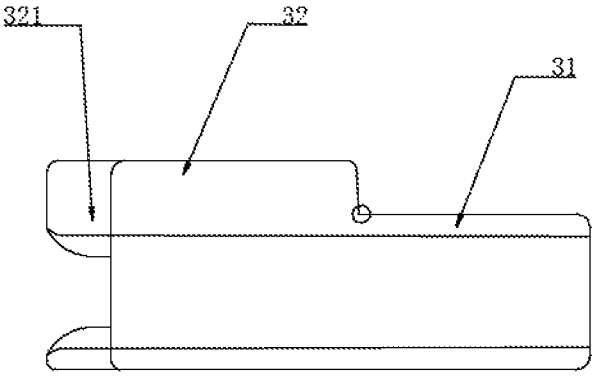
FIG. 12 schematically shows a front view of a latch according to the second embodiment of the present application.
Figure 13:
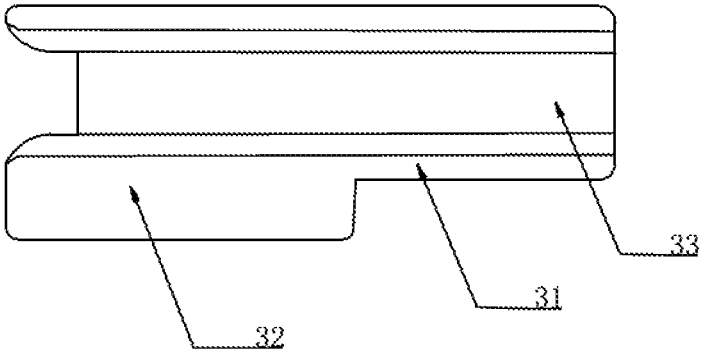
FIG. 13 schematically shows a back view of the latch according to the second embodiment of the present application.
Figure 14:
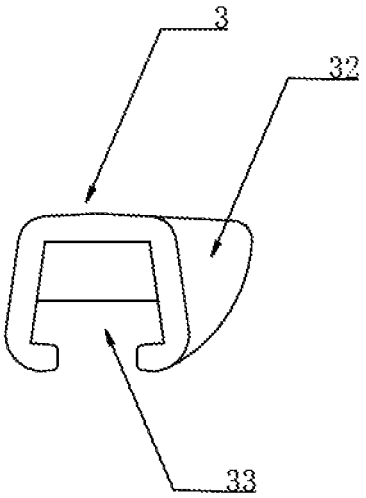
FIG. 14 schematically shows a left view of the latch according to the second embodiment of the present application.

As shown in FIGS. 8 to 11, the socket 2*a* includes a base 22 and a first protruding part 21 located above the base 22. A fourth holding groove 211 is provided on the outer side of the socket 2*a*, and a slot 221 is provided inside the base 22. As shown in FIGS. 12-14, the latch 3 includes a snap part 31 and a second protruding part 32, and a fifth holding groove 33 is provided on the outer side of the latch 3. The snap part 31 is inserted into the slot 221, and each of the fourth holding groove 211 and the fifth holding groove 33 is engaged to a respective one of the two teeth stringers. The base 22 has one side surface along the longitudinal direction being curved and one other side surface along the longitudinal direction being curved or a vertically flat, preferably curved in the present embodiment. Each of the first protruding part 21 and the second protruding part 32 is shaped with a notched right-angle arc in cross-section. The second protruding part 32 is disposed above the snap part 31 and at one side of the latch 3. The width of the snap part 31 is smaller than that of the second protruding part 32. Each of the fourth holding groove 211 and the fifth holding groove 33 has its width gradually decreases inward from the opening.

Each of the fourth holding groove 211 and the fifth holding groove 33 is engaged to the end portion of a respective one of the two teeth stringers. The chain teeth are arranged uniformly in order above the socket 2*a* and the latch 3. Before closing of the zipper, the socket 2*a* and the latch 3 are separated from each other to form an open zipper. During closing of the zipper, the snap part 31 is inserted into the bottom of the slot 221 such that the socket 2*a* and the latch 3 are tightly engaged with each other, and then the engagement between the chain teeth 1 is achieved by pulling the slider. With each of the first protruding part 21 and the second protruding part 32 being shaped with a notched right-angle arc in cross-section, when the fourth holding groove 211 and the fifth holding groove 33 are engaged to the teeth stringers, a smaller engaging gap is generated to reduce the engaging force applied during engagement, to reduce the engaging time, and to avoid damage to the chain teeth caused by excessive engaging time. With the base 22 having one other side surface along the longitudinal direction that is curved or a vertically flat, it is ensured that the socket 2*a* is more stably held at the bottom of the respective teeth stringer when engaged thereto.

Figure 10:
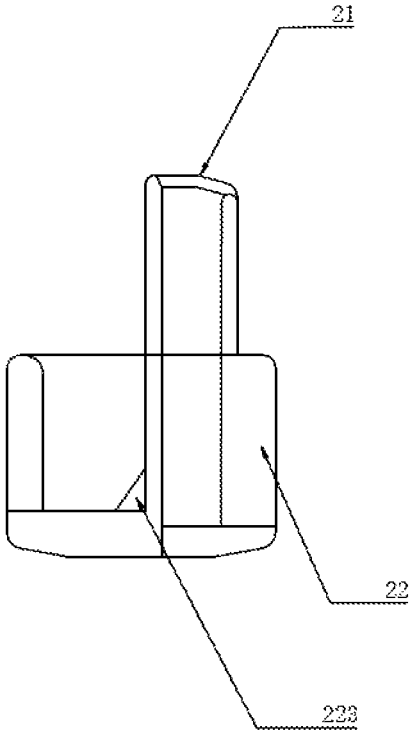
FIG. 10 schematically shows a front view of the socket according to the second embodiment of the present application.
Figure 11:
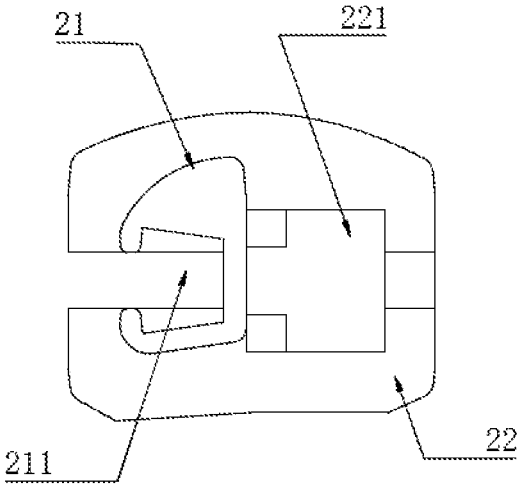
FIG. 11 schematically shows a top view of the socket according to the second embodiment of the present application.

As shown in FIG. 10, an inclined part 223 is provided on the contact surface between the slot 221 and the base 22. The inclined part 223 has an inclined angle of 45 degrees to 75 degrees, preferably 60 degrees in the present embodiment. When the snap part 31 is inserted into the slot 221, the inclined surface of the snap part 31 contacts the inclined surface of the inclined part 223. Since the width of the snap part 31 is smaller than that of the second protruding part 32, during separating of the socket 2*a* and the latch 3, the friction between the socket 2*a* and the latch 3 is reduced to avoid the over-engagement between the socket 2 and the latch 3, resulting in an easy withdrawal of the snap part 31 from the slot 221.

As shown in FIG. 12, a step 321 is provided at an upper end of the second protruding part 32, and a step surface of the step 321 is provided inside the second protruding part 32. The height of the second protruding part 32 is greater than or equal to the sum of the heights of one of the chain teeth 1 and the first protruding part 21. It can be ensured that the chain tooth 1 in contact with the second protruding part 32 and the chain tooth 1 in contact with the first protruding part 21 are tightly engaged during closure of the zipper.

As shown in FIG. 4, the top stop 4 has an arc-shaped cross-section with the center angle of a right angle. A first holding groove 43 is formed on the outer side of the top stop 4 and is engaged with the end of the teeth stringer. Two top stops 4 are provided, one of which is engaged with the teeth stringer on which the socket 2*a* is mounted, the other one of which is engaged with the teeth stringer on which the latch 3 is mounted. When the slider 5 is moved to the end of the teeth stringer, the upper stop 4 prevents the slider from sliding out of the teeth stringer.

Figure 15:
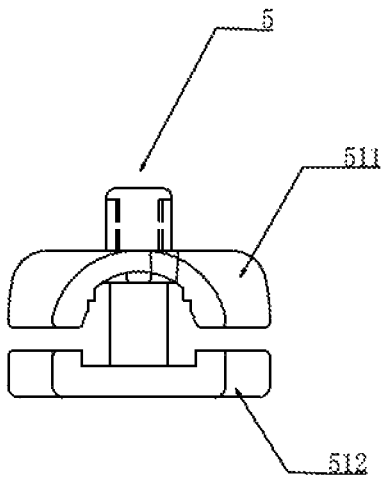
FIG. 15 schematically shows a bottom view of a slider according to the second embodiment of the present application.
Figure 16:
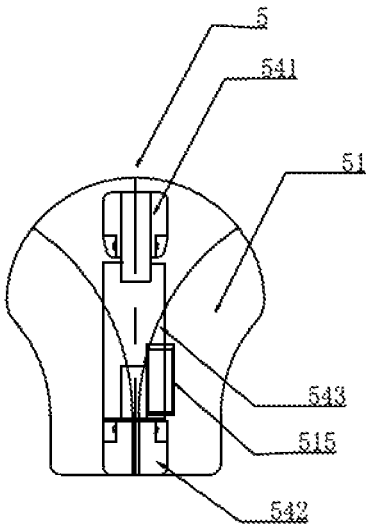
FIG. 16 schematically shows a front view of the slider according to the second embodiment of the present application.
Figure 17:
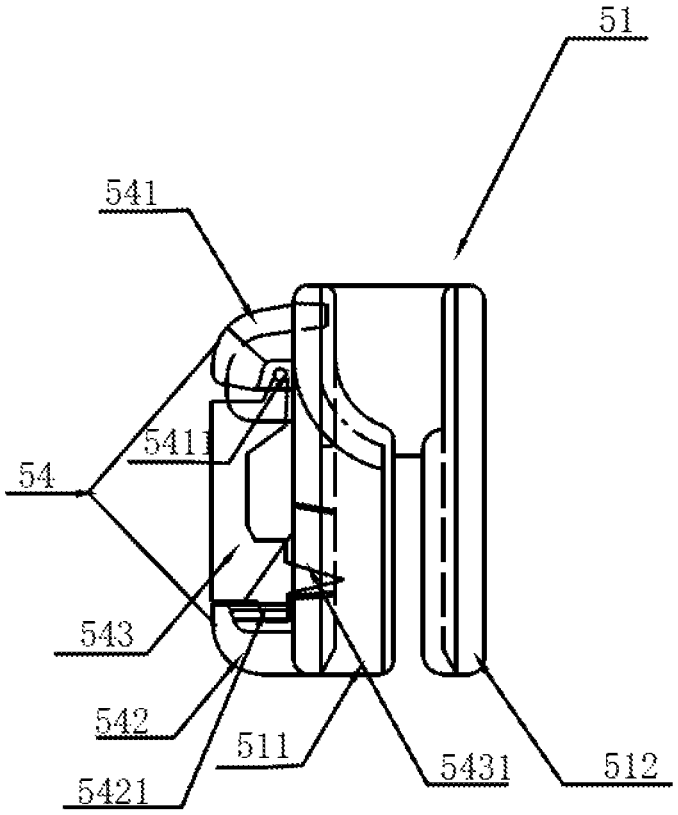
FIG. 17 schematically shows a left view of the slider according to the second embodiment of the present application.
Figure 18:
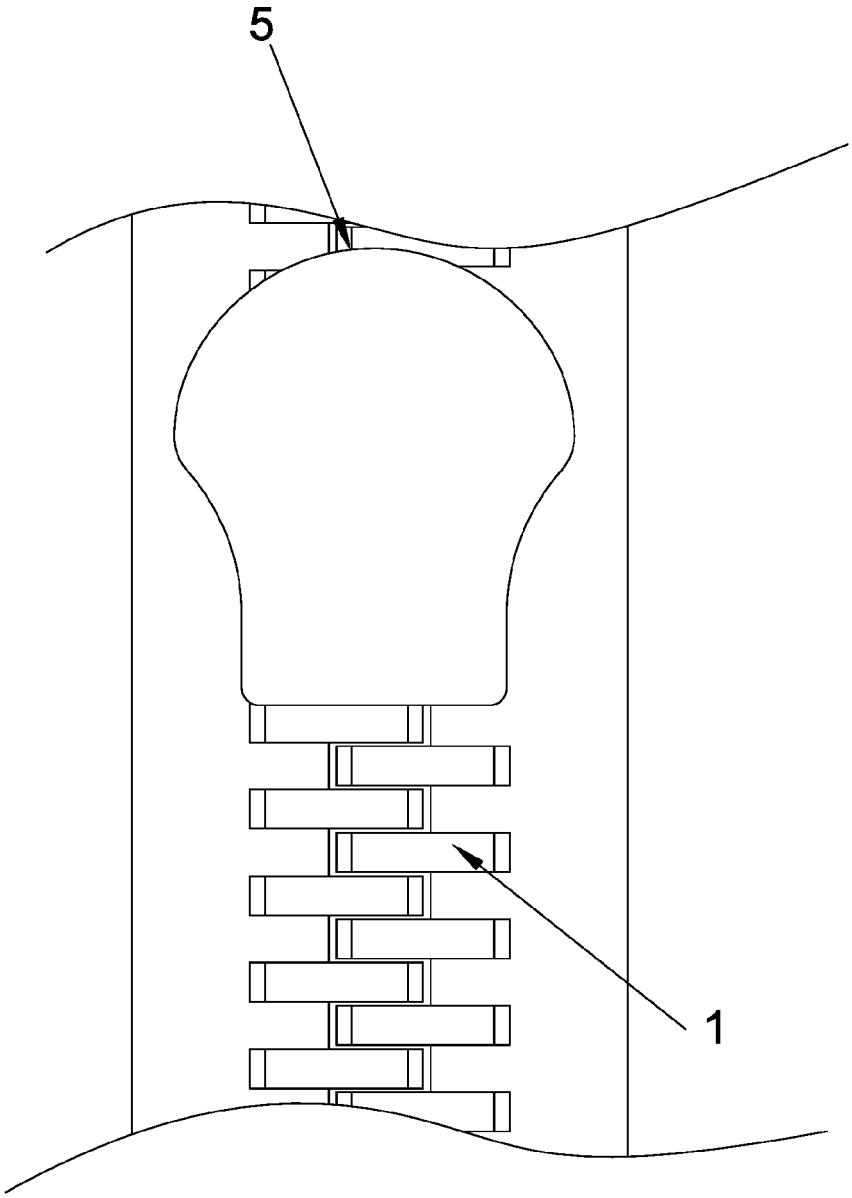
FIG. 18 schematically shows a rear view of the half-round zipper with the slider according to the second embodiment of the present application.

As shown in FIGS. 15-17, a slider 5 for use with the above zipper is also provided according to the present application, including a head 51 and a trunk 54. The head 51 is provided with an upper plate 511 and a lower plate 512. The head 51 further includes two guiding ports and an engaging port. The lower plate 512 is flat, and the upper plate 511 is half-round shaped in longitudinal cross-section at one end of the engaging port.

As shown in FIG. 17, the trunk 54 includes an upper nose 541 and a lower nose 542. The upper plate 511 is provided with an opening 515 arranged on one side of the lower nose 542. A middle nose 543 is provided between the upper nose 541 and the lower nose 542. The upper nose 541 is provided with a hinge hole 5411. The lower nose 542 is provided with a slot 5421. The middle nose 543 is provided with a self-locking member 5431. The middle nose 543 has an upper end hingedly fixed to the upper nose 541 and a lower end movable along the slot 5421. The self-locking member 5431 is inserted into the opening 515. The middle nose 543 is fixed to a pull tab (not shown) that can move the self-locking member 5431 by pulling the middle nose 543. During closing of the zipper, the slider 5 is pulled, the pull tab pulls the middle nose 543 under the external force, the self-locking member 5431 on the middle nose 543 is withdrawn from the opening 515, and the chain teeth 1 are engaged under the action of the slider. After the zipper is closed, with the slider in its natural state, the self-locking member 5431 is sprung back into the opening 515, and is inserted between the chain teeth 1 to lock the slider to prevent the slider from moving.

It should be appreciated that the present application may have other various embodiments. Modifications and variations made by those skilled in the art based on the embodiments according to the present application without any creative work also fall within the scope of the present application.

What is claimed is:

1. A half-round zipper, comprising chain teeth, at least two top stops and at least two teeth stringers, wherein each of the chain teeth has a tooth root provided with a left tooth and a right tooth curved with respect to each other, each of the chain teeth has a tooth top provided with an engaging boss and an engaging groove which are arranged respectively on both sides of the tooth top and configured to be engagable with each other, each of the chain teeth has an arc-shaped longitudinal cross-section with a center angle of a right angle, two of the chain teeth are engaged with each other to form a half-round shape, the left tooth, the right tooth and the tooth root form an arcuate groove configured to be fixedly engaged with the teeth stringer, a center of the engaging boss is located above the left tooth, and wherein each of the at least two top stops comprises an upper end portion with an arc cross-section and a lower end portion with a horizontally or obliquely flat bottom surface, a first holding groove is provided at an outer side of each of the at least two top stops and is engaged to an inner side of a respective one of the at least two teeth stringers, and each of the at least two top stops is located at a top end of the respective one of the at least two teeth stringers by means of the first holding groove.

2. The half-round zipper according to claim 1, further comprising a bottom stop that has a height greater than that of one of the chain teeth, wherein the two teeth stringers are provided; and the two top stops are provided each of which is engaged to the top end of a respective one of the two teeth stringers, the bottom stop is engaged to lower ends of the two teeth stringers to connect the teeth stringers with each other, the bottom stop comprises an upper holding portion, an intermediate transition portion, and a lower holding portion, two holding grooves symmetrical to each other with respect to a central axis of the bottom stop are formed between the upper holding portion and the lower holding portion, the two holding grooves comprise a second holding groove and a third holding groove, each of which is engaged to the inner side of a respective one of the two teeth stringers.

3. The half-round zipper according to claim 2, wherein the upper holding portion has an arc-shaped top surface, the lower holding portion has a flat or concave bottom surface, and the second holding groove and the third holding groove are equal in shape and size.

4. The half-round zipper according to claim 2, wherein each of the second holding groove and the third holding groove has a width increased and then decreased inward from an opening, and has a first inner wall located at the intermediate transition portion and being arc-shaped, and has a second inner wall located at the upper holding portion and provided with a snap notch, and has a third inner wall located at the lower holding portion and being horizontally or obliquely flat.

5. The half-round zipper according to claim 1, comprising a socket and a latch, wherein the two teeth stringers are provided, and the socket comprises a base and a first protruding part located above the base, a fourth holding groove is provided on an outer side of the socket, and a slot is provided inside the base, the base one other side surface along a longitudinal direction being curved or a vertically flat, the latch comprises a snap part and a second protruding part located at one side of the latch above the snap part, a fifth holding groove is provided on an outer side of the latch, the snap part has a width smaller than that of the second protruding pan, the snap part is inserted into the slot, and each of the fourth holding groove and the fifth holding groove is engaged to a respective one of the two teeth stringers, the base has one side surface along the longitudinal direction being curved, each of the first protruding part and the second protruding part is shaped as notched right-angle arc in cross-section, each of the fourth holding groove and the fifth holding groove has its width gradually decreases inward from an opening.

6. The half-round zipper according to claim 5, wherein an inclined part is provided on a contact surface between the slot and the base, having an inclined angle of 45 degrees to 75 degrees.

7. The half-round zipper according to claim 5, wherein a step is provided at an upper end of the second protruding pan, and a step surface of the step is provided inside the second protruding part, and the second protruding part has a height greater than or equal to a sum of the heights of one of the chain teeth and the first protruding part.

* * * * *